US006107929A

United States Patent [19]

Amari

[11] Patent Number: 6,107,929

[45] Date of Patent: Aug. 22, 2000

[54] CENTER CLUSTER MODULE

[75] Inventor: Takeyuki Amari, Shizuoka, Japan

[73] Assignee: Yazaki Corporation, Tokyo, Japan

[21] Appl. No.: 09/326,669

[22] Filed: Jun. 7, 1999

[30] Foreign Application Priority Data

Jun. 8, 1993 [JP] Japan ..... 10-159456

[51] Int. Cl.[7] ..... G08B 21/00

[52] U.S. Cl. ..... 340/687; 340/525; 340/457; 307/10.2; 439/297; 439/298

[58] Field of Search ..... 340/525, 687, 340/426, 457, 517, 654; 307/10.2; 439/297, 298, 489, 490, 347; 701/32.32

[56] References Cited

U.S. PATENT DOCUMENTS

| | | | |
|---|---|---|---|
| 4,042,832 | 8/1977 | Cassarino, Jr. et al. | 307/149 |
| 4,674,814 | 6/1987 | Hoshino et al. | 439/489 |
| 5,370,543 | 12/1994 | Hamada et al. | 439/489 |
| 5,633,624 | 5/1997 | Maeda et al. | 340/426 |

*Primary Examiner*—Jeffery A. Hofsass
*Assistant Examiner*—Daniel Previl
*Attorney, Agent, or Firm*—Sughrue, Mion, Zinn, Macpeak & Seas, PLLC

[57] ABSTRACT

A center cluster module which checks connection failures of connectors and for problems in electronic components after electronic components have been inserted into connection slot portions and informs the worker of connection status of the individual electronic components, thus improving work efficiency. A center cluster module includes a connection slot portion which removably receives a plurality of electronic components to be mounted on a vehicle. Component detection sections provided so as to correspond to individual electric components detect whether or not electronic components are inserted into the connection slot portion. From a detection signal output from each of the plurality of component detection sections, an inserted component determination section determines the state of the electronic component inserted into the connection slot portion. A display section indicates the result of the determination made by the inserted component determination section.

15 Claims, 9 Drawing Sheets

FIG. 9
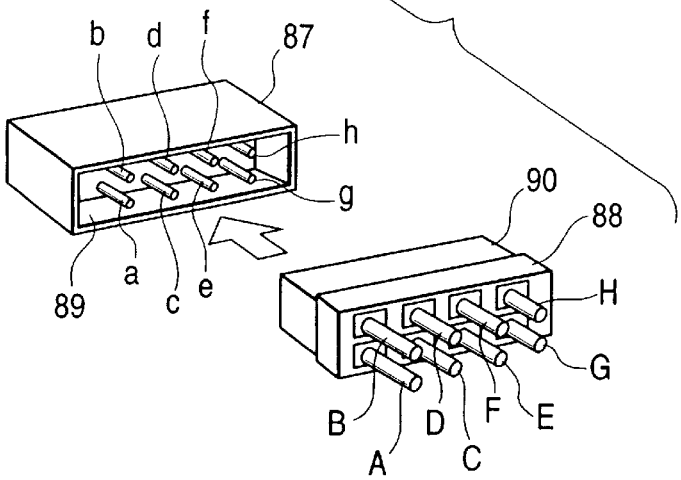
FIG. 10
| TERMINAL | TYPE |
|---|---|
| A | +B |
| B | ACC |
| C | GND |
| | |
| | |
| G | INTERCONNECTED TO H |
| H | INTERCONNECTED TO G |
FIG. 11
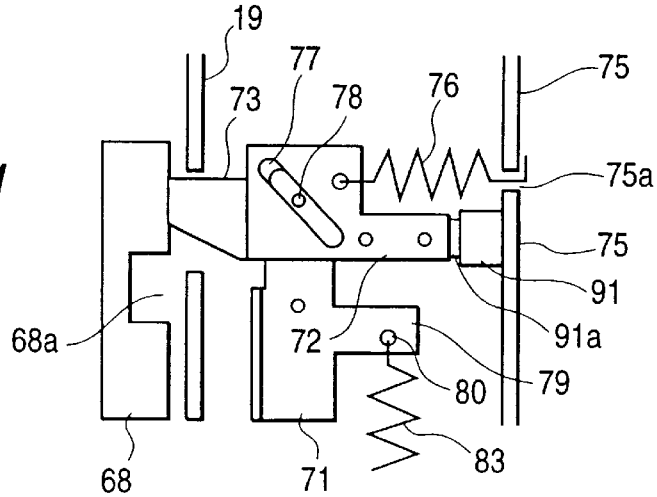

CENTER CLUSTER MODULE

BACKGROUND OF THE INVENTION

1. Field of the Invention

The present invention relates to a center cluster module which checks for connection failures of connectors and for problems in electronic components after the electronic components have been inserted into connection slot portions and informs a worker of the connection status of the individual electronic components, thus improving work efficiency.

The present application is based on Japanese Patent Application No. Hei. 10-159456, which is incorporated herein by reference.

2. Description of the Related Art

A center cluster module for housing an audio component is located in the dashboard of the car. This center cluster module is a case for receiving components of the audio unit. The power line and signal lines for each component must be linked to the module, thus complicating the routing of the power line and the signal lines. Accordingly, securing electronic components to the center cluster module consumes much time and involves considerable costs.

Each of the various electronic components is equipped with control switches. Therefore, in order to operate the switches and control, for example, an electronic component located at a lower position within the rack, the driver must cast his eyes in a downward direction, thus creating a safety hazard during driving.

FIGS. 12A and 12B show the basic configuration of a center cluster module 101 for solving the above-described problem; and FIG. 13 is a functional block diagram showing the configuration of a center cluster module system including the center cluster module 101.

As shown in FIG. 13, a head unit 112 comprises control switches 113*a*; a controller 115; a connection slot portion 119; a radio 135; and a cassette player 137*a*. As shown in FIG. 12B, racks 117*a* to 117*c* for housing various electronic components are formed in the front portion of the head unit 112, and the connection slot portion 119 connected to the electronic components is disposed behind the racks 117*a* to 117*c*.

Electronic components are connected to the connection slot portion 119, and the thus-connected electronic components are electrically connected to a bus line 141, as well as to the controller 115 by way of the bus line 141. A display 111 and the control switches 113*a* are connected to the controller 115.

The center cluster module 101 is formed so as to accommodate racks, and electronic components can be freely connected to or disconnected from the connection slot portion 119, thereby offering the capability of expanding components and improving ease of assembly. Further, the controller 115 can control the electronic components through actuation of the control switches 113*a* to 113*e* by way of the bus line 141, and the plurality of control switches are collectively located at a position where they can be easily actuated by the driver, thus improving driving safety.

As shown in FIG. 14, when the center cluster module 101 and the display 111 are fitted into the racks, a display section 110 including the display 111 is engaged with a groove 165 and is connected to a connector 168. Then, the head unit 112 is fitted to a center cluster bezel 170, and a decorative panel 171 is also fitted to the center cluster bezel 170. The thus-completed center cluster module 101 is received in an extension rack 167 of a center console 163 and is connected to a connector 169.

Electronic components, such as the radio 135 and the cassette player 137*a*, are inserted into the connection slot portion 119. As shown in FIG. 14, after another electronic component, such as the display 111, has been connected to the connection slot portion 119, the control switches 113*a* are actuated. As a result, the controller 115 determines whether or not there are connection failures or problems in the individual electronic components, by way of the network (i.e., the bus line 141 and a bus line 151).

If some of the electronic components are found to be defective, these components are not recognized and are closed. Through indication of the status of each of the electronic components on the display 111, the user can ascertain a defective electronic component.

In such a center cluster module 101, if the display 111 becomes defective, the status of other electronic components cannot be displayed. Further, after completion of assembly of all the electronic components, the worker checks the state of each of the components. In other words, the worker is unable to find a defective electronic component before assembly, thus deteriorating work efficiency.

The object of the present invention is to provide a center cluster module which checks for connection failures of connectors and for problems in electronic components after the electronic components have been inserted into a connection slot portion, informs the worker of the state of each of the electronic components, and improves work efficiency.

SUMMARY OF THE INVENTION

To this end, according to a first aspect of the present invention, there is provided a center cluster module comprising: a connection slot portion to which a plurality of electronic components disposed on a car are removably connected; a plurality of component detection means which are provided so as to correspond to the plurality of electronic components and detect whether or not the electronic components are connected to the connection slot portion; inserted component determination means for determining, on the basis of detection results output from the plurality of component detection means, the state of the electronic components inserted into the connection slot portion; and display means for indicating determination results made by the inserted component determination means.

The plurality of component detection means, provided so as to correspond to the individual electronic components, detect whether or not the electronic components are inserted into the connection slot portion. The inserted component determination means determines the state of the electronic components inserted into the connection slot portion, on the basis of the detection results output from the plurality of component detection means. The display means displays determination results determined by the inserted component determination means. Even if the existing display is broken, the center cluster module can check the state of the individual electronic components, informing the worker of the connection status of the individual electronic components. Further, a check can be made as to whether or not the electronic components are correctly connected at the time of connection of the electronic components to the connection slot portion, thereby improving work efficiency.

Preferably, the display means comprises a plurality of indicators provided so as to correspond to the individual electronic components, and each of the indicators displays the corresponding determination result.

Thus, since each of the plurality of indicators, corresponding in number to the individual electronic components, individually indicates the corresponding determination result, checking can be performed to determine whether the individual electronic components are properly connected.

Preferably, the plurality of component detection means are inserted into the connection slot portion and are activated by pressing the electronic components inserted into the connection slot portion, thereby detecting whether or not the electronic components are inserted into the connection slot portion.

Preferably, each of the plurality of component detection means has a lock mechanism to lock the electronic components to the connection slot portion. The lock mechanism locks the electronic components within the connection slot portion, thus securing the electronic components during driving and hence preventing contact failures.

Preferably, the lock mechanism comprises an expandable elastic member whose one end is connected; and a lock member which is connected to the other end of the elastic member and enters a groove formed in the electronic component by restoration force of the elastic member when the lock mechanism locks the electronic component within the connection slot.

While the electronic component is inserted into the connection slot portion, the lock member is pressed by the surface of the electronic component other than its groove, thus shrinking the elastic member. When the groove and the lock member meet, the lock member enters the groove by restoration force of the elastic member, thus locking the electronic component within the connection slot portion.

Preferably, the lock mechanism has a lock release member which is connected to the lock member and moves the lock member that has entered the groove, thereby releasing the electronic component from the connection slot portion.

Preferably, each of the component detection means is provided so as to oppose the lock member and is activated by the electronic component inserted into the connection slot portion being pressed against the lock member, thus detecting insertion of the electronic component into the connection slot portion.

BRIEF DESCRIPTION OF THE DRAWINGS

FIG. 9 is an illustration showing the configuration of the component detection section provided in a center cluster module according to a second embodiment;

FIG. 10 is a table showing the layout of terminals of a second connector provided on the component detection section shown in FIG. 9;

FIG. 11 is a schematic representation showing the configuration of the component detection section provided in a center cluster module according to a third embodiment;

DETAILED DESCRIPTION OF THE PREFERRED EMBODIMENTS

Center cluster modules according to embodiments of the present invention will now be described by reference to the accompanying drawings.

First Embodiment

Figure 1:
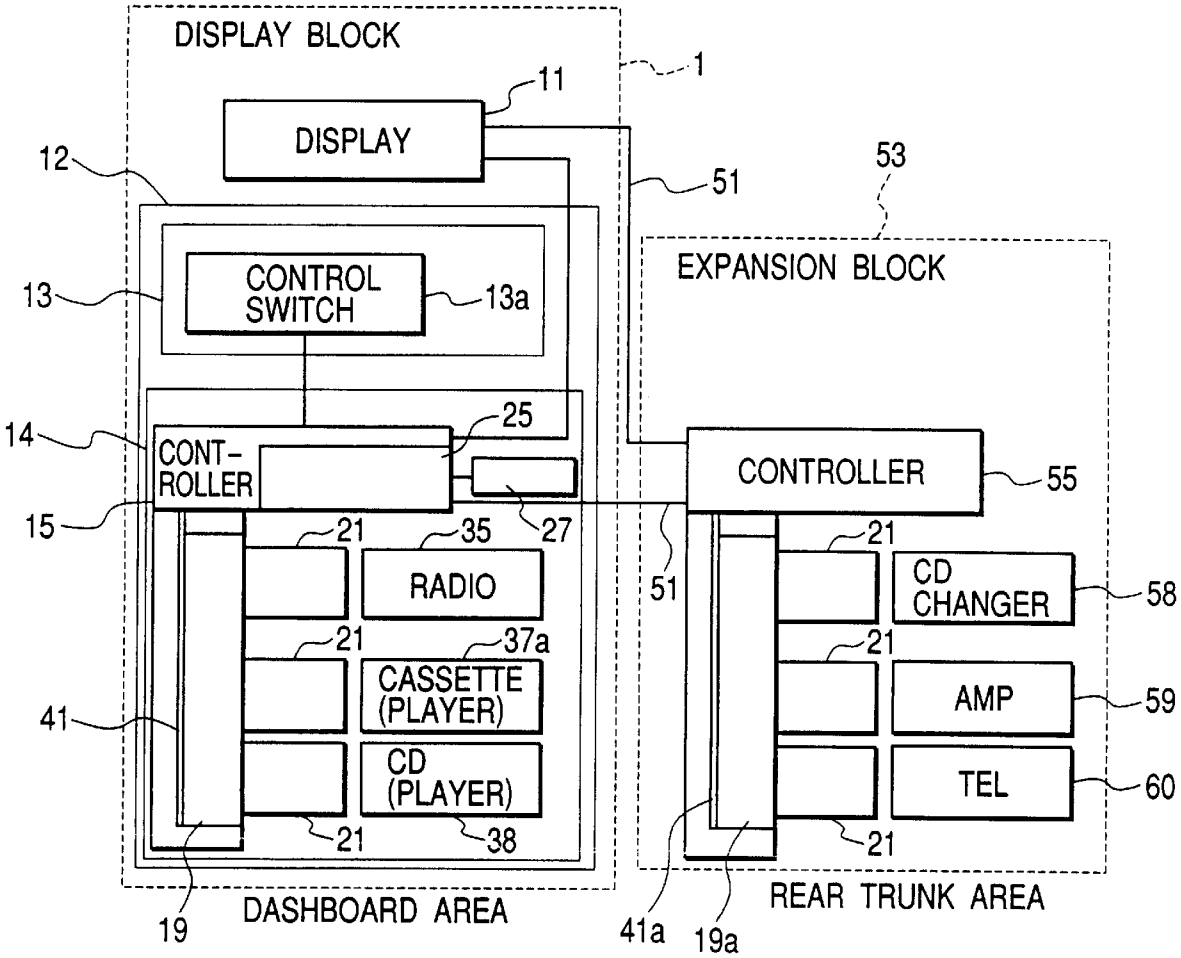
FIG. 1 is a functional block diagram showing the configuration of a center cluster module system including a center cluster module according to the present invention.

A center module according to a first embodiment of the present invention will now be described. FIG. 1 is a functional block diagram showing the configuration of a center cluster module system including the center cluster module according to the present invention. The center cluster module 1 is disposed in the dashboard of a vehicle such as an automobile and comprises a display block and a standard block (hereinafter referred to as a "head unit").

The display block comprises a display 11 for indicating audio-and-video data (hereinafter referred to as "A-V data"). The head unit 12 comprises a switch unit 13 and a main unit 14. The main unit 14 is equipped with a controller 15 and a connection slot portion 19.

The connection slot portion 19 is designed so as to removably receive electronic components (hereinafter simply referred to as "components") such as a radio 35, a cassette player 37*a*, and a compact disk player (hereinafter abbreviated "CD player") 38. Component detection sections 21 are provided within the connection slot portion 19 so as to correspond to the individual components. Each of the component detection sections 21 detects whether or not the corresponding component is inserted into the connection slot portion 19.

A bus line 41 is disposed in the connection slot portion 19 for interconnecting the components fitted into the connection slot portion 19. This bus line 41 is connected to the controller 15.

The switch unit 13 comprises a plurality control switches 13*a* to 13*e* (only the control switch 13*a* is shown in FIG. 1) the number of which corresponds to the number of components connected to the connection slot portion 19 and the corresponding components.

The controller 15 controls the components connected to the connection slot portion 19 by way of the bus line 41, through use of control signals output from the control switches 13*a* to 13*e*.

The controller 15 has an inserted component determination section 25 for determining, on the basis of a detection signal output from each of the component detection sections 21, whether or not a component is inserted into the connection slot portion 19. The display section 27 has a simple configuration and indicates the result of the determination made by the inserted component determination section 25.

The center cluster module 1 is also connected to an expansion block 53 located in a rear trunk by way of a bus line 51. The expansion block 53 houses a CD changer and an MD changer, which cannot be housed in the center cluster module 1 located in the dashboard.

The expansion block 53 comprises the component detection sections 21 and components, such as a controller 55 including a communications IC, a connection slot portion 19*a*, a CD changer 58, an amplifier 59, and a telephone 60. The CD changer 58, the amplifier 59, and the telephone 60 are inserted into the connection slot portion 19*a* equipped with the component detection sections 21. A bus line 41*a*, identical in structure to the bus line 41, is disposed behind the connection slot portion 19*a*, and the components are connected to the bus line 41*a*.

The controller 15 is connected to the controller 55 by way of the bus line 51, and data communication is established between the center cluster module 1 and the expansion block 53. Detection signals, output from the component detection sections 21 provided in the expansion block 53, are sent to the inserted component determination section 25 disposed in the controller 15, by way of the controller 55 and the bus line 51.

From the detection signal output from the component detection section 21 disposed in the expansion block 53, the controller 55 may determine whether or not the CD changer 58 or like component is inserted into the connection slot portion 19*a*.

Figure 2:
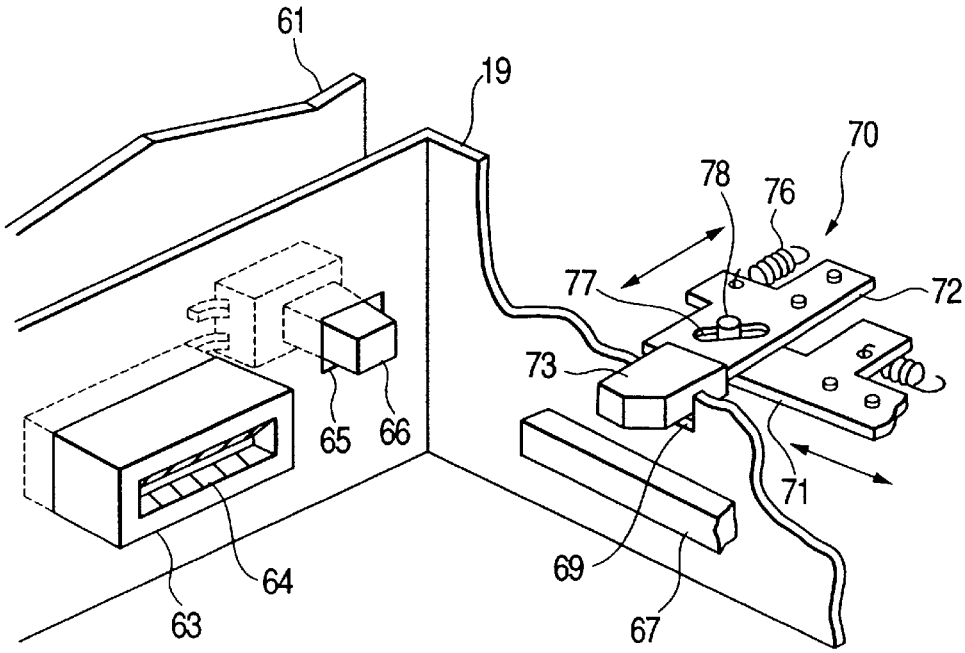
FIG. 2 is a perspective view showing details of individual component detection sections provided within the center cluster module shown in FIG. 1.
Figure 3:
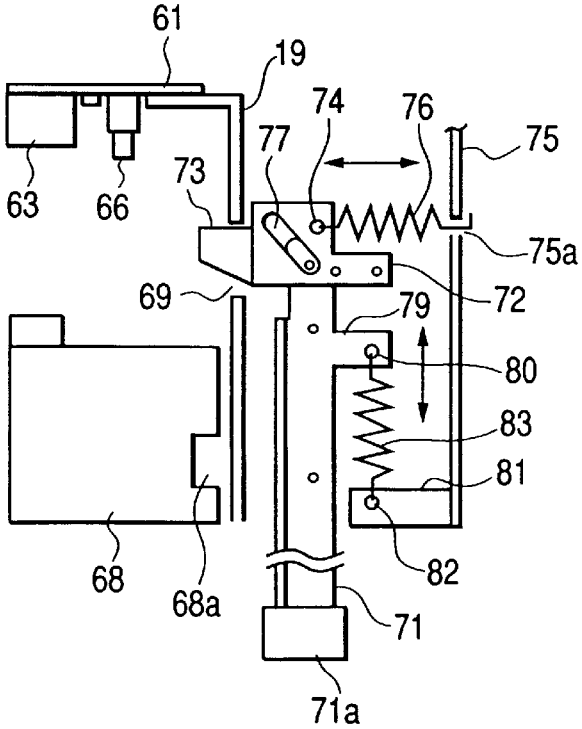
FIG. 3 is a schematic top view showing the structure of the component detection section shown in FIG. 2.

FIG. 2 is a detailed perspective view showing one of the component detection sections, and FIG. 3 is a top view of the component detection section shown in FIG. 2. In FIG. 2, a bus board 61 equipped with the bus line 41 (FIG. 1) is provided with a female connector 63 and a position detection switch 66.

A connector section 64 is formed within the female connector 63 and receives the leading end of a component 68. The leading end of the position detection switch 66 is inserted into an opening 65 formed in the connection slot portion 19. When the leading end of the position detection switch 66 comes into contact with the component 68, the position detection switch 66 detects insertion of the component 68 into the connection slot portion 19. Each of the component detection sections 21 provided in the connection slot portion 19 has a pair of rails 67 for guiding the component 68 to the interior of the component detection section 21, and the component 68 has a groove 68*a*.

The component detection section 21 also has a lock mechanism 70 for locking and releasing the component 68 within or from the connection slot portion 19. The lock mechanism 70 comprises a first link 71 and a second link 72 connected to the first link 71 and a stopper 73 is attached to the second link 72. The stopper 73 passes through a notch 69 formed in the connection slot portion 19.

A spring 76 extends between a hole 74 formed in the second link 72 and a member 75 and expands and contracts in the direction denoted by arrows (i.e., in the horizontal direction in FIG. 3) in response to external force. A joint pin 78 is mounted on the first link 71 and is inserted into an elongated hole 77 formed in the second link 72.

Another spring 83 extends between a hole 80 formed in a protuberance 79 of the first link 71 and a hole 82 formed in a member 81 and contracts and expands in the direction denoted by arrows (i.e., the vertical direction in FIG. 3).

A switch press section 71*a* is provided at the leading end of the first link 71. As a result of the switch press section 71*a* being pressed, the joint pin 78 slides within the elongated hole 77, thus moving the stopper 73 in the rightward direction.

The operation of the component detection section 21 having the foregoing structure will now be described by reference to FIGS. 4 and 5. First, as shown in FIG. 3, when the component 68 is not inserted into the connection slot portion 19, no external force is exerted on the spring 76 from the component 68, and hence the spring 76 is in a fully-expanded state. Accordingly, the stopper 73 fully enters the interior of the connection slot portion 19.

Figure 4:
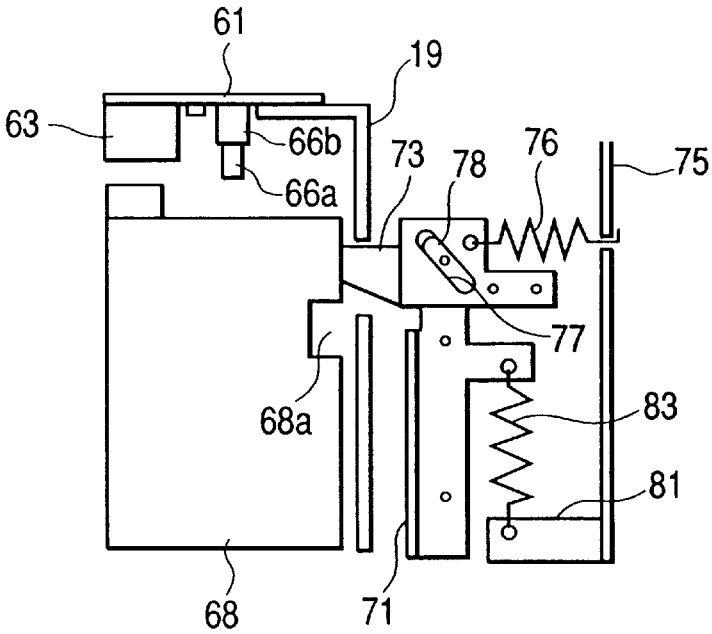
FIG. 4 is a schematic top view showing an electronic component when it presses a stopper.

Next, as shown in FIG. 4, when the component 68 comes into contact with the stopper 73, the stopper 73 is pressed by the component 68 and is displaced to the rightward direction. As a result, the spring 76 contracts, and the joint pin 78 slides upward within the elongated hole 77 in conjunction with the rightward displacement of the stopper 73, thereby expanding the spring 83.

Figure 5:
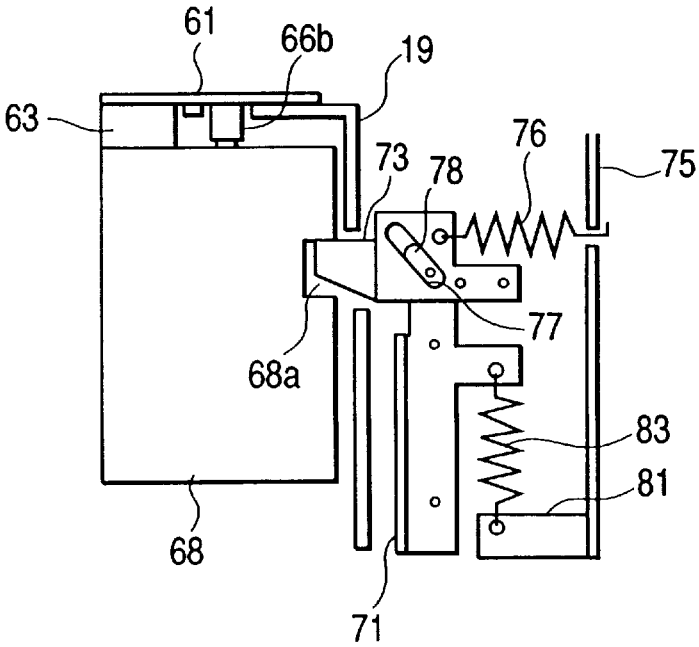
FIG. 5 is a schematic top view showing the electronic component when it is locked.

Further, as shown in FIG. 5, the leading end of the component 68 fits into the female connector 63, so that the component 68 comes into contact with the leading end 66*a* of the position detection switch 66. Thus, the position detection switch 66 detects insertion of the component 68 into the connection slot portion 19. At this time, the stopper 73 enters the groove 68*a* formed in the component 68.

At this time, the stopper 73 moves toward the leftward direction, thereby locking the component 68. In the state shown in FIG. 5, in which the component 68 is locked, the lock mechanism 70 returns to its original state shown in FIG. 3.

To release the component 68 from a locked state, the operator pushes the switch press section 71*a*, so that the joint pin 78 slides within the elongated hole 77 and the stopper 73 is again displaced toward the rightward direction. As a result, the stopper 73 is disengaged from the groove 68, thereby releasing the component 68 from the locked state.

Figure 7:
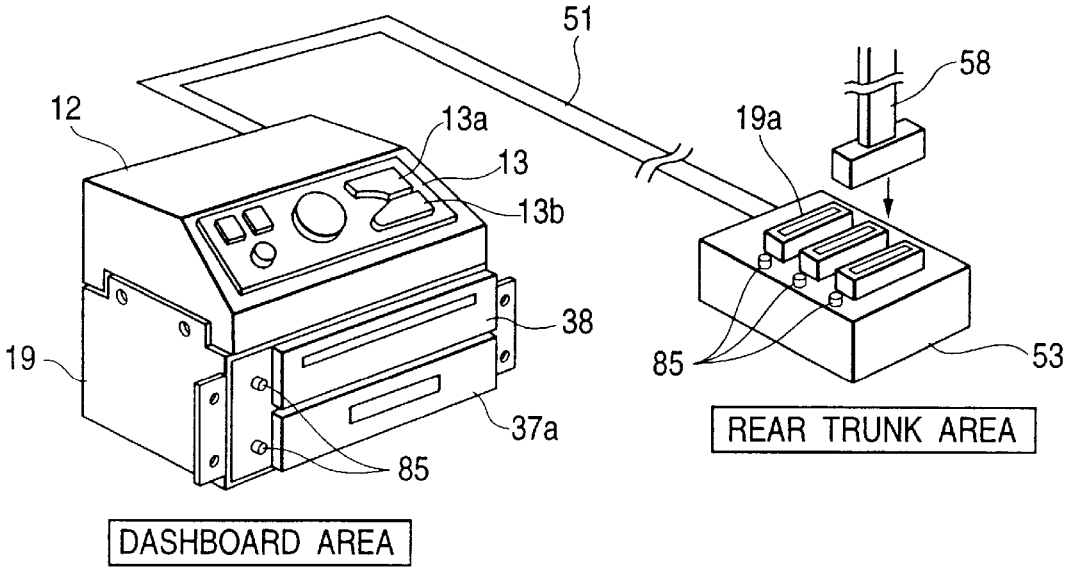
FIG. 7 is an illustration showing the configuration of the center cluster module system including the center cluster module according to a first embodiment.

FIG. 7 is a schematic representation showing the basic configuration of the center cluster module system including the center cluster module according to the first embodiment. The plurality of control switches 13*a*, 13*b*, etc are disposed on the head unit 12, and the cassette player 37*a* and the CD player 38 are inserted into the connection slot portion 19. Indicators 85, for indicating the result of the determination made by the inserted component determination section 25, are provided on the left-hand side of the cassette player 37*a* and the CD player 38, in a number equal to the components inserted into the connection slot portion 19.

The expansion block 53 located in the rear trunk is connected to the head unit 12 by way of the bus line 51 and is equipped with the component connection slot portion 19*a*. The component connection slot portion 19*a* removably receives components such as the CD changer 58, and the indicators 85 serving as the display section 27 are disposed, on the left-hand side of the connection slot portion 19*a*, in a number equal to the number of the components. These indicators 85 are connected to the controller 55.

Figure 6:
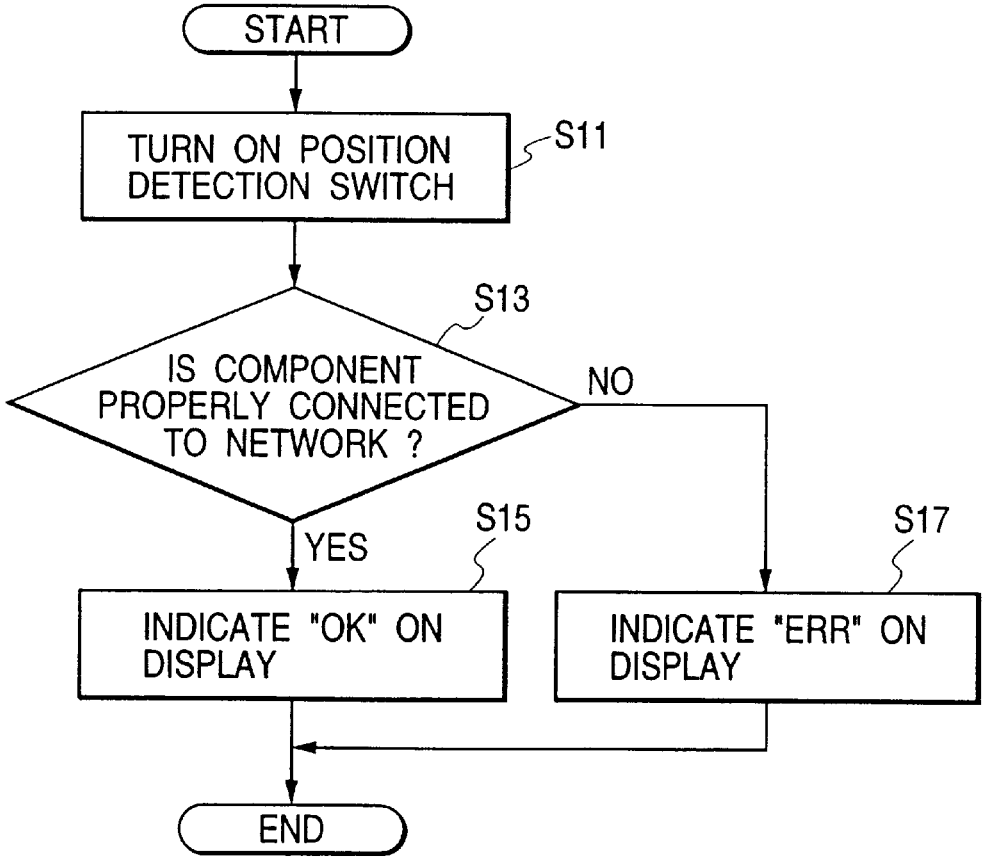
FIG. 6 is a flowchart showing the operation of the center cluster module.

The operation of the center cluster module according to the first embodiment will now be described by reference to the flowchart shown in FIG. 6.

First, when the component 68 is inserted into the connection slot portion 19, the position detection switch 66 is turned on (step S11) and transmits an inserted-component detection signal as a detection signal to the inserted component determination section 25 disposed within the controller 15.

On the basis of the inserted-component detection signal, the inserted component detection section 25 determines whether or not the component is inserted into the connection slot portion 19; namely, whether or not the component is properly connected to the network (i.e., the bus line 41 or 51) of the components (step S13).

If the component is properly connected to the network, a display "OK" is indicated as a determination result on the indicator 85 shown in FIG. 7 (step S15). In this case, the display is indicated on only the indicator 85 corresponding to the component that is inserted into the connection slot portion 19.

In contrast, if the component is not properly connected to the network, a display "ERR" (abbreviation of ERROR) is displayed as a determination result on the indicator 85 (step S17). For example, a green light-emitting diode and a red light-emitting diode are used for a single indicator 85. If the determination result is OK, the green light-emitting diode may be illuminated. In contrast, if the result is ERR, the red light-emitting diode may be illuminated. In other words, the determination result may be indicated in different colors.

Alternatively, if the determination result is OK, the light-emitting diode may be blinked twice. In contrast, if the determination result is ERR, the light-emitting diode may not be blinked. In short, the determination result may be indicated by blinking of the light-emitting diode.

Figure 8:
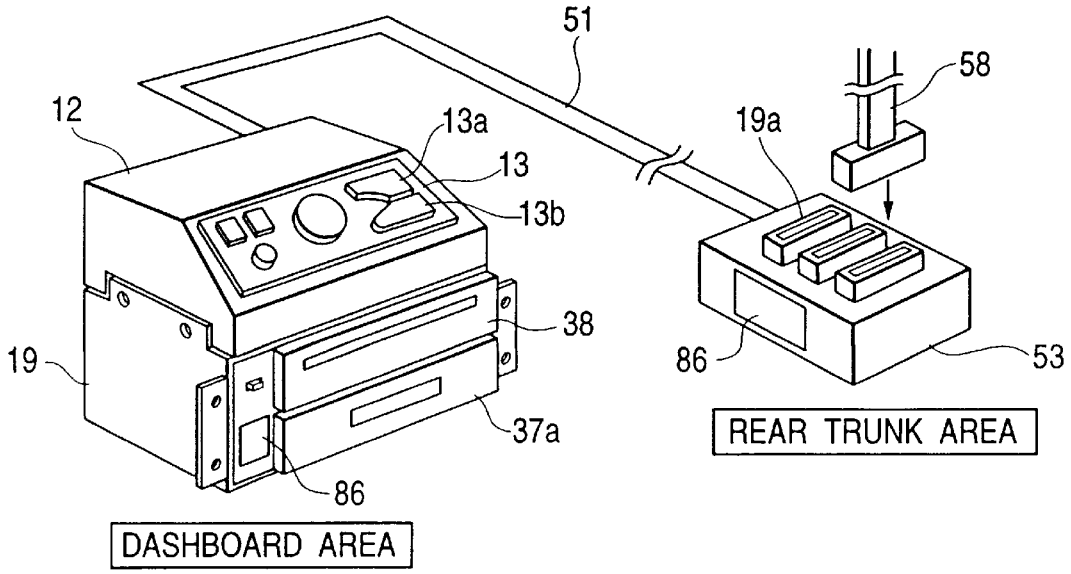
FIG. 8 is an illustration showing another example of configuration of the center cluster module.
Figure 12A:
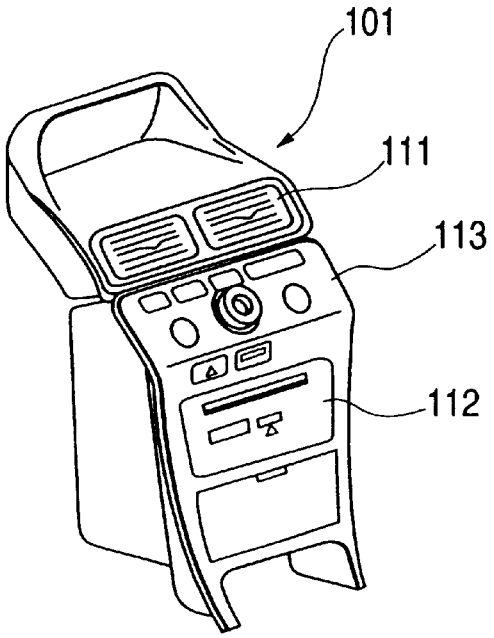
FIGS. 12A and 12B are perspective views showing the basic configuration of the related center cluster module.
Figure 12B:
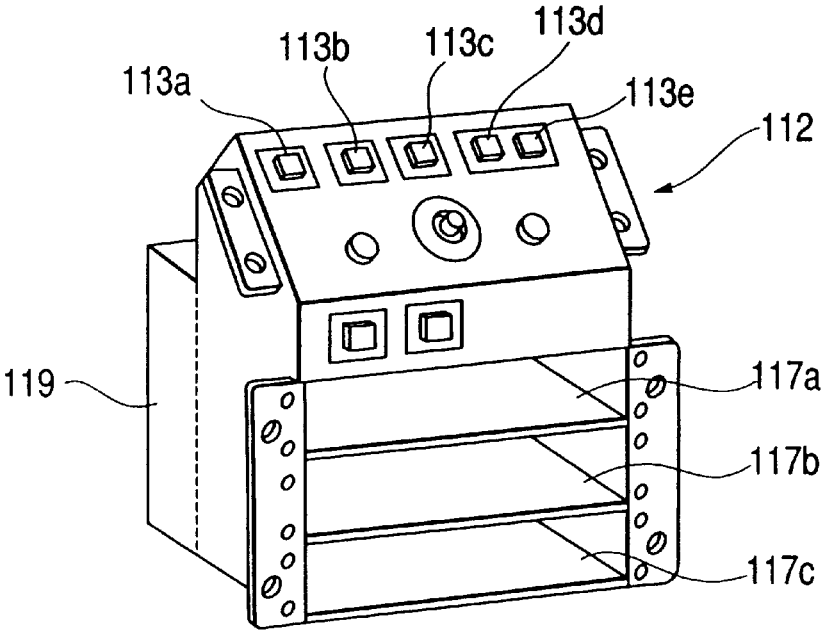
Figure 13:
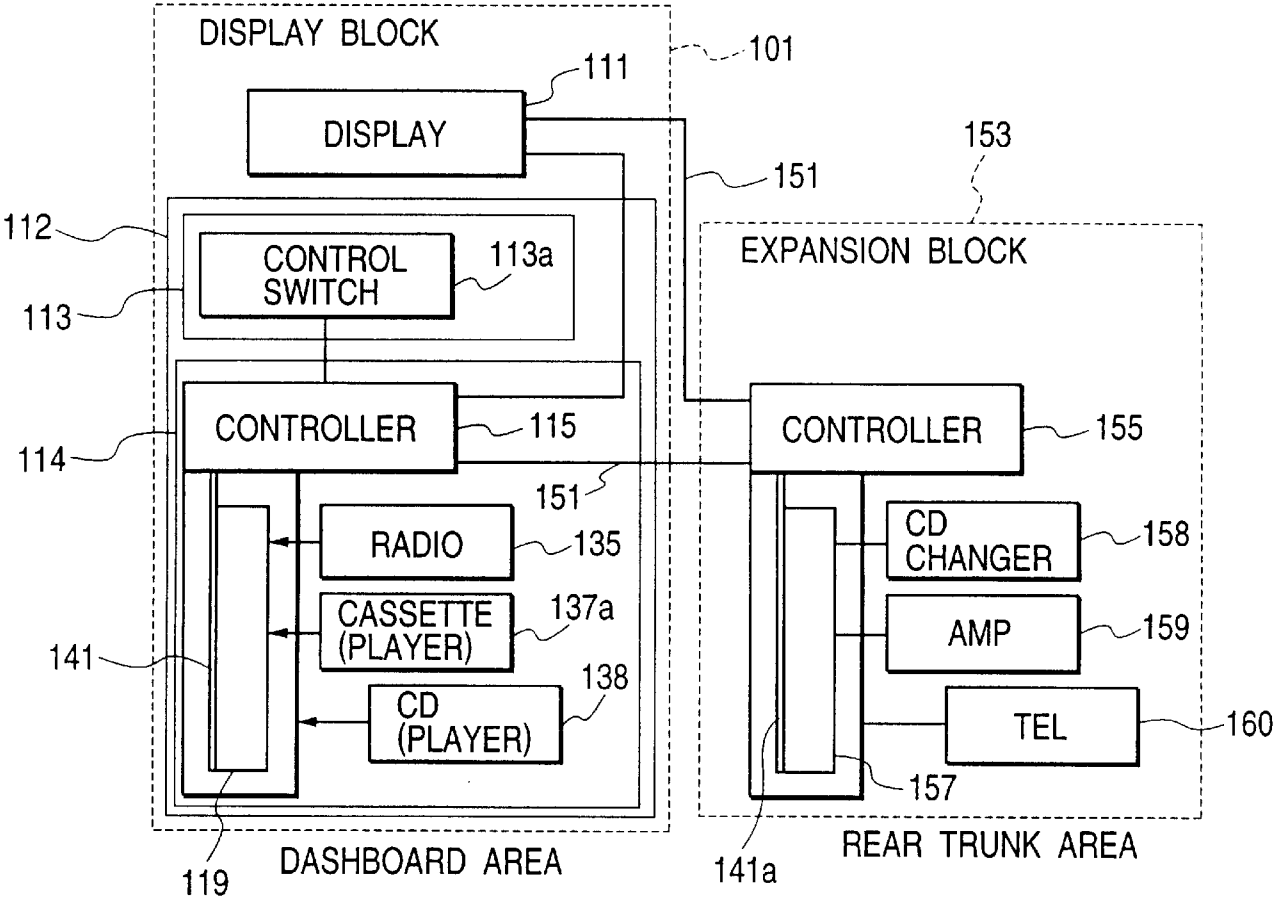
FIG. 13 is a functional block diagram showing the configuration of the center cluster module shown in FIGS. 12A and 12B.
Figure 14:
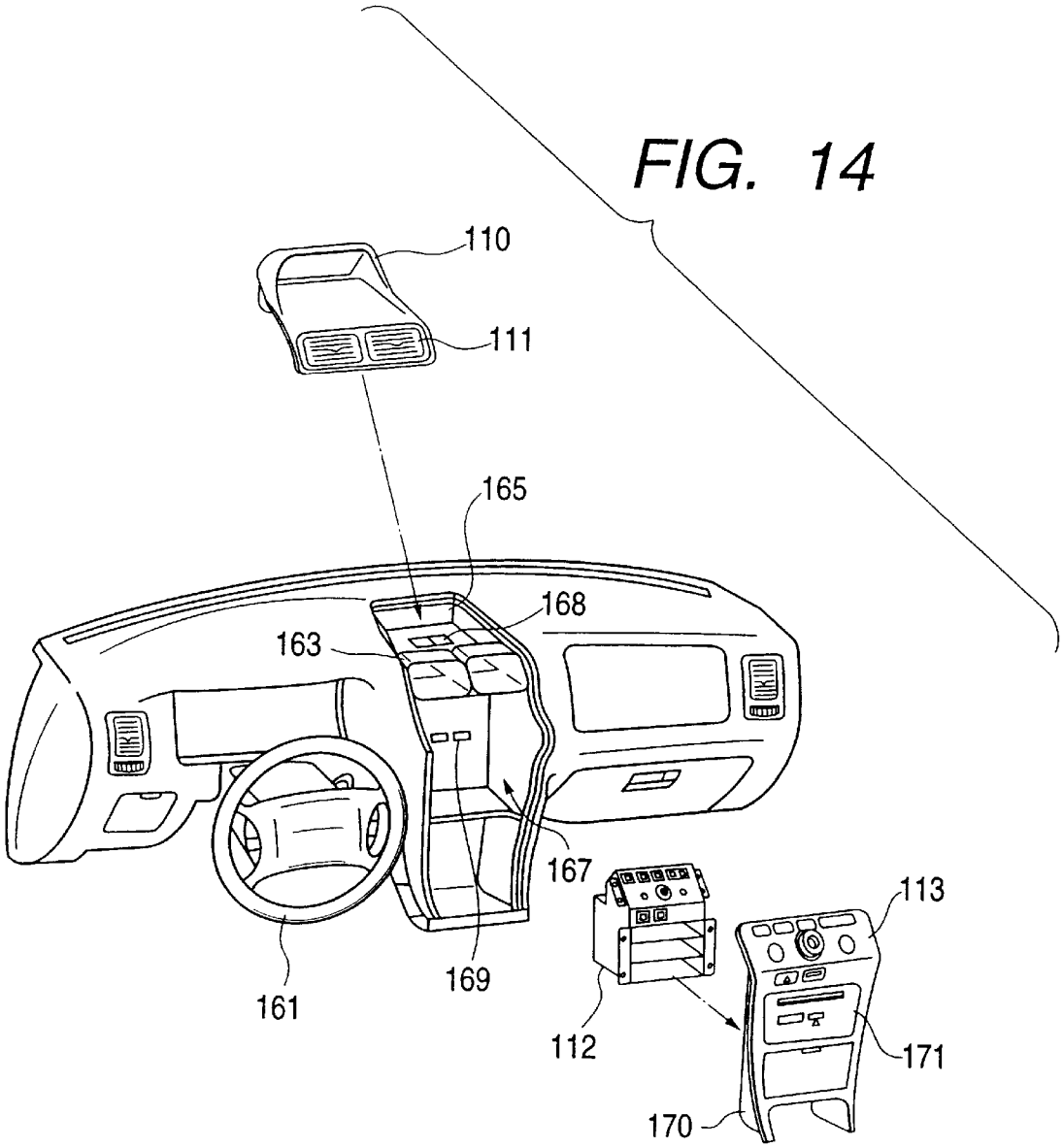
FIG. 14 is an illustration showing the assembly of the center cluster module shown in FIGS. 12A and 12B into racks.

As shown in FIG. 8, in place of the indicators 85, a display 86, which differs in configuration from the display 11, may be disposed in each of the dashboard and the rear trunk. Characters "OK" and "ERR" may be indicated as determination results on the displays 86, or icons (graphical characters) representing "OK" and "ERR" may be indicated as determination results on the displays 86.

As mentioned above, the connection slot portion 19 has the component detection sections 21, and this component detection section 21 detects insertion of the component into the connection slot portion 19. From the detection signal output from the component detection section 21, the inserted component determination section 25 determines the state of the component and indicates the determination result on the display section other than the display 11.

Even if the display 11 is broken for any reason, a determination can be made as to whether or not a component is inserted. Further, when a component is inserted into the connection slot portion, a check can be made as to whether or not the component is properly connected to the connection slot portion.

Consequently, the connection status of all the individual components can be checked before the components are assembled into the center cluster module. More specifically, failures in the components may be found before the components are assembled into the cluster center module, thereby improving work efficiency. Further, the worker is encouraged to again insert the electric component into the connection slot portion or to consider the solution of a problem of the electric component through examination, thus improving work efficiency.

Second Embodiment

A center cluster module according to a second embodiment of the present invention will now be described with reference to FIGS. 9 and 10.

In the center cluster module according to the first embodiment, the position detection switch 66 disposed on the bus board 61 is pressed by the component, thereby detecting insertion of the component into the connection slot portion 19.

FIG. 9 is a perspective view showing the structure of the component detection section of the center cluster module according to the second embodiment. As shown in FIG. 9, the component detection section comprises a first connector 87 mounted on a bus board 61 and a second connector 88 capable of mating with the first connector 87. The second connector 88 is mounted on an electrical component.

The first connector 87 has an opening 89, and eight terminals "a" to "h" are disposed within the opening 89. The second connector 88 has an opening 90, which mates with the opening 89, and eight terminals A to H, which mate with the eight corresponding terminals "a" to "h," respectively.

FIG. 10 is a table providing the layout of terminals of the second connector. In the second connector 88, the terminal A is supplied with power +B; the terminal B corresponds to an accessory (ACC); and the terminal C is grounded (GND). Further, the terminals G and H are interconnected together by way of an unillustrated lead wire.

In the component detection section having the foregoing configuration, when the second connector 88 is not mated with the first connector 87, the terminals "h" and "g" of the first connector 87 remain in an unconnected state. When the component 68 is inserted into the connection slot portion 19, the second connector 88 mates with the first connector 87, thereby connecting the terminal "h" to the terminal H and the terminal "g" to the terminal "G." Since the terminals H and G are interconnected, the terminal "h" and "g" are also interconnected. In short, the terminals "h" and "g" are short-circuited.

A short-circuit signal is sent to the controller 15 by way of the bus board 61 and the bus line 41. From this short-circuit signal, the controller 15 can determine that the component has been inserted into the connection slot portion 19.

Third Embodiment

A center cluster module according to a third embodiment of the present invention will now be described. FIG. 11 shows the configuration of the component detection section provided within the center cluster module according to the third embodiment.

As shown in FIG. 11, in the component detection section according to the third embodiment, a position detection switch 91 is mounted on the member 75, in place of the position detection switch 66 (according to the first embodiment shown in FIG. 3) being mounted on the bus board 61. Further, the third embodiment is characterized in that the position detection switch 91 is provided so as to oppose the second link 72.

The position detection switch 91 is connected to the bus board 61 (see FIG. 1) of the member 75 and is identical in structure with the position detection switch 66 shown in FIG. 3. In other respects, the component detection section shown in FIG. 11 is identical in structure with that shown in FIG. 3, and the components which are the same as those shown in FIG. 3 are assigned the same reference numerals. Hence, repetition of their detailed components is omitted here.

In the component detection section having such a configuration, when the component 68 is inserted into the connection slot portion 19 and reaches the stopper 73, the stopper 73 is displaced in the rightward direction. The position detection switch 91 is then pressed by way of the second link 72 and is thereby turned on. The detection signal is sent from the position detection switch 91 to the controller 51 by way of the member 75, the bus board 61, and the bus line 41. On the basis of the detection signal, the inserted component determination section 25 can determine whether or not the component 68 is inserted into the connection slot portion 19.

Since the position detection switch 91 is provided on the stopper 73, the component 68 can be checked after having been reliably connected to the connection slot portion 19.

The present invention is not limited to any one of the center modules according to the first through third embodiments. As a matter of course, the present invention can be embodied in the form of various modifications within the scope of the technical idea underlying the present invention.

As has been described above, according to the first aspect of the present invention, the plurality of component detection means provided so as to correspond to the individual electronic components detect whether or not the electronic components are inserted into the connection slot portion. The inserted component determination means determines the state of the electronic components inserted into the connection slot portion, on the basis of the detection results output from the plurality of component detection means. The display means displays determination results determined by the inserted component determination means. Even if the existing display is broken, the center cluster module can check the state of the individual electronic components, informing the worker of the connection status of the individual electronic components. Further, a check can be made as to whether or not the electronic components are correctly connected at the time of connection of the electronic components to the connection slot portion, thereby improving work efficiency.

Further, since each of the plurality of indicators provided so as to correspond to the individual electronic components individually indicates the corresponding determination result, there can be performed checking as to whether or not the individual electronic components are properly connected.

Further, the plurality of component detection means inserted into the connection slot portion are activated by pressing of the electronic components inserted into the connection slot portion, thus enabling detection as to whether or not the electronic components are inserted into the connection slot portion.

Further, the lock mechanism locks the electronic components within the connection slot portion, thus securing the electronic components during driving and hence preventing contact failures.

Further, while the electronic component is inserted into the connection slot portion, the lock member is pressed by the surface of the electronic component other than its groove, thus shrinking the elastic member. When the groove and the lock member meet, the lock member enters the groove by restoration force of the elastic member, thus locking the electronic component within the connection slot portion.

The lock release member connected to the lock member moves the lock member that has entered the groove, thus releasing the electronic component from the connection slot portion.

The component detection means located so as to oppose the lock member is activated by the electronic component inserted into the connection slot portion being pressed against the lock member, thus enabling detection of insertion of the electronic component into the connection slot portion.

What is claimed is:

1. A center cluster module, comprising:

a connection slot portion to which a plurality of electronic components disposed on a car are removably connected;

a plurality of component detectors disposed in said connection slot portion, which are provided so as to correspond to the plurality of electronic components, for detecting whether the electronic components are connected to the connection slot portion;

a determinator for determining, on the basis of detection results output from the plurality of component detectors, the state of the electronic components inserted into the connection slot portion; and a display for indicating determination results made by the determinator.

2. The center cluster module as defined in claim 1, wherein the display comprises a plurality of indicators provided so as to correspond to the individual electronic components, and each of the indicators displays the corresponding determination result.

3. The center cluster module as defined in claim 1, wherein the plurality of component detectors are disposed in the connection slot portion and are activated by pressing of the electronic components inserted into the connection slot portion, thereby detecting whether or not the electronic components are inserted into the connection slot portion.

4. The center cluster module as defined in claim 1, wherein each of the plurality of component detectors has a lock mechanism for locking the electronic components to the connection slot portion.

5. The center cluster module as defined in claim 4, wherein the lock mechanism comprises an expandable elastic member fixed at one end; and a lock member which is connected to the other end of the elastic member and enters a groove formed in the electronic component by elastic force of the elastic member when the lock mechanism locks the electronic component within the connection slot portion.

6. The center cluster module as defined in claim 5, wherein the lock mechanism includes a lock release member which is connected to the lock member and moves the lock member that has entered the groove, thereby releasing the electronic component from the connection slot portion.

7. The center cluster module as defined in claim 5, wherein each of the component detectors is provided so as to oppose the lock member and is activated by the electronic component inserted into the connection slot portion being pressed against the lock member, thus detecting insertion of the electronic component into the connection slot portion.

8. An electronic module arrangement, comprising:

a first connection slot portion to which a first set of a plurality of electronic components disposed on a car are removably connected;

a first set of a plurality of component detectors disposed in said first connection slot portion, which are provided so as to correspond to the first set of plurality of electronic components, for detecting whether the electronic components are connected to the connection slot portion;

a second connection slot portion, located remote from said first connection slot portion, to which a second set of a plurality of electronic components are removably connected;

a second set of a plurality of component detectors disposed in said second connection slot portion, which are provided so as to correspond to the second set of plurality of electronic components, for detecting whether the electronic components are connected to the connection slot portion;

determination means for determining, on the basis of detection results output from the plurality of component detectors of said first and second sets, the state of the electronic components inserted into the first and second connection slot portions; and a display for indicating determination results made by the determination means.

9. The electronic module arrangement as defined in claim 8, wherein said first connection slot portion is located inside a passenger compartment of the car and said second connection slot portion is located inside a trunk of the car.

10. The electronic module arrangement as defined in claim 8, wherein the display comprises a plurality of indicators provided so as to correspond to the individual electronic components, and each of the indicators displays the corresponding determination result.

11. The electronic module arrangement as recited in claim 8, wherein the plurality of component detectors are disposed in the respective first and second connection slot portions and are activated by pressing of the electronic components inserted into the respective connection slot portions, thereby detecting whether or not the electronic components are inserted into the respective connection slot portions.

12. The electronic module arrangement as defined in claim 8, wherein each of the plurality of component detectors has a lock mechanism for locking the associated electronic component to the associated connection slot portions.

13. The electronic module arrangement as defined in claim 12, wherein the lock mechanism comprises an expandable elastic member fixed at one end; and a lock member which is connected to the other end of the elastic member and enters a groove formed in the associated electronic component by elastic force of the elastic member when the lock mechanism locks the electronic component within the associated connection slot portion.

14. The electronic module arrangement as defined in claim 13, wherein the lock mechanism includes a lock release member which is connected to the lock member and moves the lock member that has entered the groove, thereby releasing the associated electronic component from the associated connection slot portion.

15. The electronic module arrangement as defined in claim 13, wherein each of the component detectors is provided so as to oppose the lock member and is activated by the associated electronic component inserted into the associated connection slot portion being pressed against the lock member, thus detecting insertion of the electronic component into the connection slot portion.

* * * * *